United States Patent [19]

Wildi

[11] 4,272,038

[45] Jun. 9, 1981

[54] THREAD-TENSIONING DEVICE ON A WARP CREEL

[75] Inventor: Edwin Wildi, Niederuzwil, Switzerland

[73] Assignee: Maschinenfabrik Benninger AG, Uzwil, Switzerland

[21] Appl. No.: 151,704

[22] Filed: May 20, 1980

[30] Foreign Application Priority Data

May 31, 1979 [CH] Switzerland ..... 5062/79

[51] Int. Cl.[3] ..... B65H 59/24

[52] U.S. Cl. ..... 242/150 R; 242/131

[58] Field of Search ..... 242/150 R, 150 M, 147 R, 242/149, 131, 131.1

[56] References Cited

U.S. PATENT DOCUMENTS

| | | | |
|---|---|---|---|
| 3,459,389 | 8/1969 | Wildiet al. | 242/150 R |
| 4,202,511 | 5/1980 | Koslowski | 242/150 R |

*Primary Examiner*—Stanley N. Gilreath

*Attorney, Agent, or Firm*—Werner W. Kleeman

[57] ABSTRACT

A disc brake, formed from a lower disc and an upper disc, is fitted on a carrier which is fastened in position to a warp creel part by means of a single screw. The lower disc rests on a rotary cage which carries a gearwheel. This gearwheel meshes with a pinion on a drive shaft. This drive shaft runs at the point where the thread coming out of the warp creel is to be deflected towards a lapping machine and thereby forms, at the same time, a driven deflecting rod for deflecting the thread. Moreover, connected turnably to the drive shaft is a beveled part which forms, with its surface, part of a peripheral positioning of the upper disc and, at the same time, causes the upper disc to turn intermittently via the frictional connection with this upper disc. A pressure element, which is clamped releasably in a clamping piece, acts centrally on the upper disc. This clamping piece is connected via a pedestal to an adjusting sheet bar via which the pressure load of the upper disc can be varied simultaneously for several thread-tensioning devices.

10 Claims, 2 Drawing Figures

THREAD-TENSIONING DEVICE ON A WARP CREEL

BACKGROUND OF THE INVENTION

1. Field of the Invention

The present invention relates to a thread-tensioning device on a warp creel, especially for warping and beam warping machines, in which the thread unwound from a bobbin is guided through in a straight line between the discs of a disc brake, the lower disc of which is driven by a drive shaft running outside the disc periphery and the upper disc of which is pressable resiliently against the lower disc, and in which the thread is deflectable, as it leaves the creel, by a deflecting device towards the lapping machine.

2. Description of the Prior Art

A thread-tensioning device of this type is known, for example, from Swiss Patent Specification 452,452. In the case of this known thread-tensioning device, the lower disc of a disc pair rests via a damping disc on a bevel wheel carrying a gearwheel rim which meshes with a pinion on a drive shaft. The disc pair and drive shaft are accommodated completely in an upright creel profile part, U-shaped in cross-section, which supports further disc pairs in the same way. Thread-guide eyelets are provided in the legs of the profile part to guide the thread in a straight line between the discs of each disc pair. After the thread has passed through the second thread-guide eyelet, viewed in the direction of the thread run, it is deflected through about 90° round the margin of the eyelet. Other thread-tensioning devices known, for example, from French Patent Specification No. 2,271,161, use deflecting bars instead of sleeves or eyelets as the deflecting device.

As is known, any deflection of a thread in the warping or beam warping process presents problems, for various reasons. On the one hand, with each deflection, the thread experiences, between its feed and delivery, an increase in tension due to friction at the deflecting device. This increase in tension depends on the design of the deflecting device, on the material used therefor and, of course, also on the thread quality. In addition, a further factor substantially influencing the friction and consequently the thread tension is the increasing soiling of the deflecting device which occurs during operation or even, where the threads always slide at the same point, as is the case, as a rule, with deflecting devices in the form of deflecting bars or thread-guide eyelets, possible wearing of these points. Precisely these last-mentioned factors, which influence the frictional conditions at the deflecting points, are naturally different for each deflecting point, as a result of which, for the threads of a creel which are combined, for example, into a warp section, different tension conditions arise within the warp section and these adversely influence the quality of the warped and where relevant also beam-warped warp.

In addition, when eyelets or deflecting bars are used to deflect the threads, in the case of certain thread qualities, very particularly, for example, in the case of glass threads, fibrils are buckled up during deflection and the threads are damaged by this phenomenon known as "fibril separation".

However, when using thread-tensioning devices of the above-mentioned type, difficulties often arise even with the disc pairs at the warping and beam-warping speeds conventional today and, in the currently likewise conventional universal application of the same thread-tensioning devices, both for natural staple fibers and for textured polyamides and polyesters, glass fibers, etc.

Owing to a frequently insufficient take-up of the upper disc by the running thread, the latter is subjected to a large local wear. At the same time, however, there occur here also, as at the deflecting points, dirt deposits which change the frictional conditions and thereby adversely affect the desired uniformity of the thread tension for all threads processed simultaneously.

SUMMARY OF THE INVENTION

The object of the invention is to provide a thread-tensioning device with which local wearing of the parts touched by the thread and, due to thorough self-cleaning, soiling of the parts are largely prevented and which, with a very simple construction and using parts made mainly of plastic which are therefore inexpensive and yet can be produced with high precision, also meets all other requirements demanded today of a thread-tensioning device for a warp creel, namely, for example, that the parts coming in contact with the threads and therefore subjected to wearing are exchangeable easily and quickly and the requisite replacement parts are cheap, that the action of each thread-tensioning device can be adjusted rapidly and that the parts of the device need to be cleaned as rarely as possible, but that this cleaning can then be effected quickly and simply, so that the creel does not have to be shut down for too long a time.

All these requirements are met with the thread-tensioning device according to the invention, which also offers a series of further advantages in comparison with hitherto known thread-tensioning devices.

For this purpose, the invention provides, in a thread-tensioning device, that the drive shaft for driving the lower disc forms at the same time the deflecting device for the thread and that the upper disc is centered peripherally and partly by means of a part which sits on the drive shaft in a turn-proof manner and causes, in a frictional manner, the upper disc to turn.

Due to the fact that the drive shaft for the drive, known per se, of the lower disc of the disc pair takes the place and assumes the function of the deflecting device, a substantial simplification of construction results, since special eyelets, sleeves or deflecting bars can be omitted. However, a further substantial advantage is that due to the constant turning of this shaft during the operation of the thread-tensioning device, the thread deflected at the shaft comes in contact with alternating faces of the deflecting device, as a result of which, in addition to the self-cleaning effect obtained and the removal of dirt, also the disadvantageous local wear phenomena are at least reduced. Likewise, due to the friction drive of the upper disc by the drive shaft, local wear phenomena are counteracted on this disc also, and a continuous self-cleaning effect on its face coming in contact with the thread is achieved.

It is especially advantageous if, according to one embodiment of the thread-tensioning device according to the invention, the drive shaft service as the deflecting device is driven around the device in the direction of the thread run, since a reduction of the friction of the thread at its deflecting point and, simultaneously, assistance in the unwinding of the thread are achieved.

An especially simple and quickly releasable connection of the thread-tensioning device to the creel is obtained if, according to a development of the thread-tensioning device made in accordance with the invention, its carrier has positioning cams intended for insertion into associated openings of a creel part and is connected releasably to the creel part by means of a single screw.

In an advantageous embodiment, a deflecting sleeve pushed in a turn-proof manner onto the drive shaft is situated in the region of the line of contact of the thread with the deflecting device and at one end of this deflecting sleeve there adjoins a part of the carrier of the thread-tensioning device through which passes the drive shaft and at the other end there adjoins the part designed as a bevel which drives the upper disc via its convex surface. A guide groove for the thread is obtained by means of the two parts which adjoin the deflecting sleeve and project beyond its surface. Due to the conical construction of the drive part for the upper disc, it is also ensured that when the thread is threaded into the thread-tensioning device it enters the region of the deflecting sleeve. On the other hand, the lower limitation of the deflecting sleeve prevents the thread from dropping out of the region of the sleeve if the tension decreases.

An advantageous embodiment of a thread-tensioning device, according to the invention in which the upper disc is pressed resiliently against the lower disc by a pressure element acting, via a spring, on the center of the upper disc, is obtained if the spring is supported at one end against a gripping sleeve which is slidable on a pressure pin surrounded by the spring and which is mounted releasably in a clamping piece connected to a pedestal which is fastened to a displaceable sheet bar which runs parallel to the pressure pin and by means of which the compressive load of several identical thread-tensioning devices is variable simultaneously.

In comparison with an embodiment as shown by the above-mentioned Swiss Patent Specification No. 452,452, a thread-tensioning device constructed in this way has the advantage that the pressure element can be fitted without tools by engaging it into the clamping piece and can likewise be released simply as a whole so as either to be exchanged or to enable the upper disc to be removed, for example, in order to eliminate dirt or for the detachment of the lower disc.

Moreover, if the connection between the clamping piece and pedestal is chosen so that the clamping piece is lockable on the pedestal in various positions, then, in addition to the identical common adjustments of several thread-tensioning devices via the sheet bars, the effect of each pressure element can also be adjusted individually.

BRIEF DESCRIPTION OF THE DRAWING

An exemplary embodiment of a thread-tensioning device according to the invention is illustrated in the attached drawing, in which.

DETAILED DESCRIPTION OF THE PREFERRED EMBODIMENTS

Figure 1:
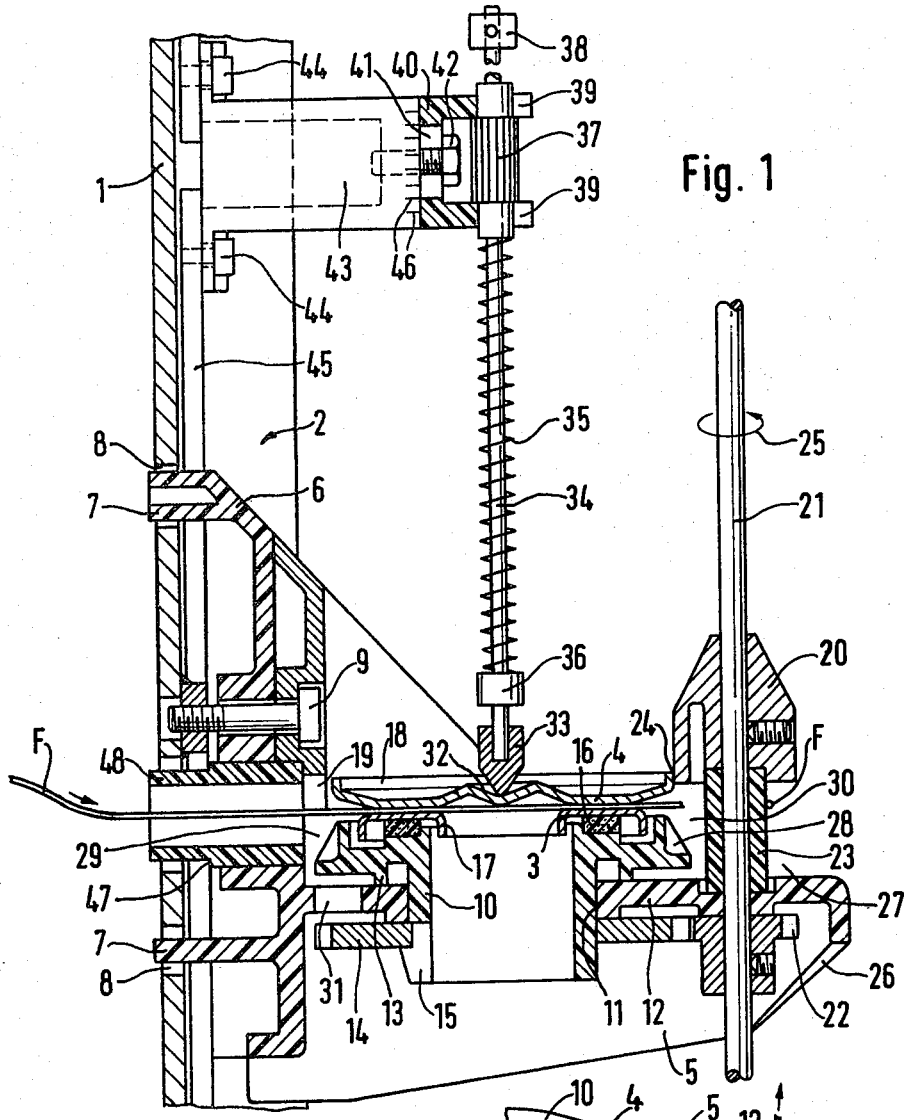
FIG. 1 is a vertical section through a part of a vertical tension bar of a warp creel with one of the thread-tensioning devices arranged thereon.
Figure 2:
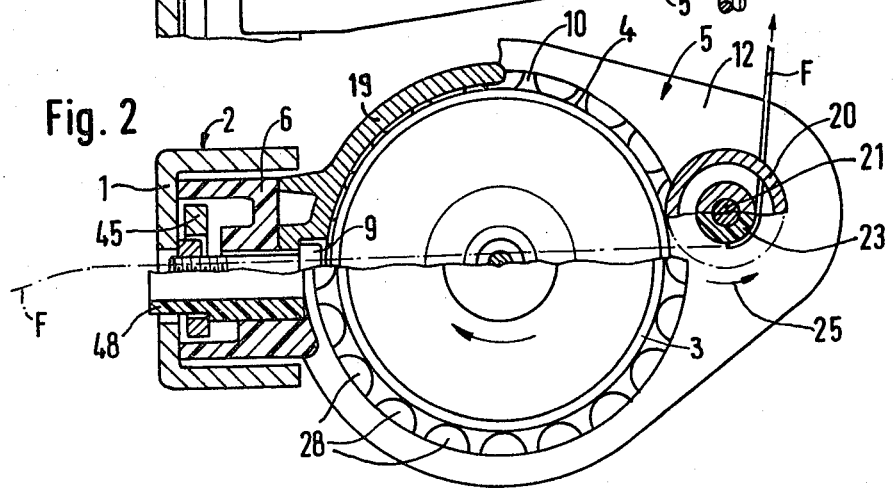
FIG. 2 is a sectional view in a horizontal plane through the thread-tensioning device of FIG. 1.

A warping system is used to illustrate the construction and mode of operation of the subject of the invention.

In this system, threads, unwound from a large number of bobbins mounted in a creel and deflected towards the warping machine after each thread has passed through a stop motion and thread-tensioning device assigned to it, are combined into a thread field and are guided through a lease comb and a reed so as to be wound as a warp section, with as uniform a tension as possible, onto the winding drum of the warping machine. Only the parts of an individual thread guide which are necessary for the understanding of the invention are illustrated in the figures.

In the creel a plurality of bobbins are arranged-in a known way closely above one another in horizontal decks in a creel frame. The thread F unwound from each bobbin is drawn through the crossbar 1 of a profile bar 2, U-shaped in cross-section, which is situated in the immediate vicinity of the particular bobbin. Arranged in or on this bar 2 are all the thread-tensioning devices for the threads of those bobbins which form a vertical row in the creel. The bars 2 as a whole form the braking panel of the creel. After it has left the bar 2, the thread F is guided through between the lower disc 3 and the upper disc 4 of a disc brake described in detail below and is thereafter deflected through about 90° towards the winding drum, not shown, of the warping machine by means of a deflecting device likewise described in detail below.

From its entry into the bar 2 to its deflecting device, the thread F runs in a straight line, which greatly facilitates its drawing-in since the drawing-in tool used can be a simple straight tool which needs to be guided only straight through the opening in the bar 2 and between the two discs 3 and 4.

A carrier 5, appropriately injection-molded from plastic, serves to mount each disc brake on the profile bar 2. Said carrier 5 has a foot 6 with two positioning cams 7, the profile bar 2 being provided with suitable openings 8 to receive said cams. After being suspended in the positioning cams 7, the entire thread-tensioning device can thereby be fitted to the profile bar 2 in the correct position by means of a simple screw 9, upon insertion into the openings 8, and can be removed again just as simply for the purpose of replacement or cleaning.

A part 12 of the carrier 5, which part runs horizontally when the thread-tensioning device is fitted, has a central bore 11 in which a rotary cage 10 is mounted turnably. This rotary cage 10 lies loosely on the carrier part 12 via a circular rib 13. On the opposite side of the carrier part 12 a gearwheel 14 is pushed onto the hub of the rotary cage 10, said gearwheel 14 limiting axial displacements of the fitted rotary cage 10. The rotary cage 10 is likewise advantageously made of plastic and is provided at the end of its hub with cams 15 via which the gearwheel 14 is pushed onto the hub and is prevented from turning in relation to the rotary cage 10, for example by means of flat areas.

The rotary cage 10 carries a damping ring 16, for example made of foam material, on which the lower disc 3 of the disc pair rests. This disc 3 has in its center a downwardly drawn collar 17 which projects into the opening of the rotary cage 10 and by means of which dirt deposited between the discs leaves the disc brake. The outer margin, also, of the disc 3 is drawn downwardly so that the thread F cannot be damaged at projecting edges as it passes through the disc brake.

The upper disc 4 of the disc brake lies freely on the lower disc 3 and is guided, with an outer upwardly drawn collar 18, on the one hand, on the inner face of a centering segment 19 formed on the carrier 5 and, on the other hand, on the outer face of a bevel 20 described in detail below, so that the two discs 3 and 4 lie approximately centrally on one another.

On its side of the disc brake lying opposite the profile part 2 and outside said disc brake, the carrier 5 has a bore through which passes a drive shaft 21. This drive shaft 21 runs parallel to the profile bar 2 and is driven turnably by a motor not shown in detail. It passes in the same way through each carrier 5 of the thread-tensioning devices arranged vertically above one another on the profile part 2 and it thus forms the common drive shaft for said devices. In the region of each thread-tensioning device, a pinion 22 is screwed firmly to the shaft 21 in a turnproof manner under the respective carrier 5 and meshes with the gearwheel 14 connected to the rotary cage 10 in a turn-proof manner, said pinion 22 thereby causing, when the shaft 21 is turning, the lower disc 3 of the disc brake to turn, via the rotary cage 10 and the damping ring 16, in a direction opposite the direction of rotation of the shaft 21. On the side of the carrier part 12 lying opposite the pinion 22, a deflecting sleeve 23 is pushed onto the drive shaft 21 and the bevel 20 adjoining said sleeve 23 is fastened in a turn-proof manner on the shaft 21 by means of a setscrew. The longitudinal extension of the sleeve 23 is such that, on the one hand, it is cut by the plane of contact between the two discs 3 and 4 and, on the other hand, the bevel 20 adjoining this sleeve 23 and sitting on the shaft 21 is connected by its convex surface at 24 to the collar 18 of the upper disc 4 in a frictionally driving manner.

Because the drive shaft 21 takes the place of a deflecting bar or other deflecting device, not only is a substantial simplification of the construction and the requisite parts of the thread-tensioning device obtained, but, due to the deflecting sleeve 23 which turns, in the case of a turn-proof fastening, with the shaft 21, or is caused to turn by the thread F in the case of a mounting turnable in relation to the shaft 21, always alternating parts of the sleeve 23 are touched by the thread F deflected round said sleeve 23, as a result of which local wear is largely prevented. At the same time, the thread contact faces of the sleeve 23 are automatically cleaned by the thread F due to the turning action. The same is true also of the upper disc 4 which is caused to turn intermittently due to the friction of its collar 18 with the bevel 20 and which has likewise changing contact faces with the thread F guided between the discs 3 and 4.

The drive shaft 21 is advantageously driven in the direction of the arrow 25, that is to say, in the same direction in which the thread F also runs round the sleeve 23. A smaller friction of the thread F thereby results and, at the same time, the unwinding of the thread F is also assisted. Accordingly, in this case the two discs 3 and 4 are driven in a direction opposite thereto.

By arranging the deflecting sleeve 23 in the above-mentioned way between the bevel 20, which widens conically in an axial direction towards the sleeve 23, and the carrier part 12, which, due to an inclined rib 26, likewise forms an abutting face which widens conically towards the sleeve 23, a guide groove 27 for the thread F is formed, on the one hand. On the other hand, the advantage is afforded that, especially when the thread F is threaded in, the thread F slides into its groove 27 via the bevel 20 easily and safely and without the danger of being caught. If it happens that the thread F drops due to a loose thread field, as a rule, it remains lying on the part 12. However, should it fall out of its groove 27, it is guided by itself again into its groove 27 when tension is restored along the rib 26. The rib 26 at the same time helps to protect the drive wheel pair parts 22 and 14 from soiling.

The rotary cage 10 is provided with a plurality of recesses 28 through which impurities can escape from spaces 29 and 30. Tests have shown that the dirt occurring in the space 30 is eliminated by means of the turning deflecting sleeve 23.

Additional openings 31 in the part 12 of the carrier 5, besides further enabling dirt to be removed, serve primarily to facilitate on the spot cleaning of the carrier 5, in the region of the rotary cage 10, by means of compressed air.

The upper disc 4 is provided in its center with a conical indentation 32 which centers the device for controlling the thread tension on the disc brake. This indentation 32 receives a conically tapering pressure head 33 which is pushed onto the end of a pressure pin 34. The pressure pin 34 is surrounded by a compression spring 35 which is supported at one end against a collar 36 of the pressure pin 34 and at the other end against a gripping sleeve 37 displaceable axially on the pressure pin 34. A setting ring 38 at the free end of the pressure pin 34 prevents the sleeve 37 and spring 35 from falling out.

The pressure element formed by the parts 33–38 is clamped, via the gripping sleeve 37, between resilient clamping fingers 39 of a clamping piece 40 which is preferably made of plastic. The connection can be made and unmade without tools, thus permitting a rapid and simple exchange of the pressure element, for example, to replace it with one whose spring 35 has a different compression characteristic.

The clamping piece 40 has a slot 41 via which it is lockable, by means of a locking screw 42, to a pedestal 43 and at different heights in relation to said pedestal 43. The pedestal 43 is, in turn, fastened by means of two screws 44 to a control sheet bar 45 which is guided between the legs of the profile bar 2 and can be adjusted vertically by means not shown in detail. One pedestal 43 for each thread-tensioning device is fastened to the control sheet bar 45, so that, by vertical adjustment of the sheet bar 45, the lower ends of the pressure pins 34 of all thread-tensioning devices arranged on the profile bar 2 are pressed, via the respective pedestal 43, the clamping piece 40, the gripping sleeve 37 and the compression spring 35, simultaneously by the same value more or less onto the upper discs 4 of the disc brakes respectively assigned to them. The adjustability of the clamping piece 40 in relation to the pedestal 43 thereby permits an individual setting of the load of the upper disc 4 for each disc brake, independently of the overall adjustment by means of the control sheet bar 45, as a result of which differentiated pressure element settings are made possible, this being advantageous, especially in the case of long creels, for compensating thread tension differences resulting from the varying thread paths between the first and last bobbin. To enable adjustments to be repeatable, the pedestal 43 is provided with marking lines 46 for this purpose.

In the exemplary embodiment illustrated, the passage of the thread F through the profile bar 2 is effected by means of a sleeve 48. To enable a wide range of different types of thread F to be processed and to facilitate maintenance work, the sleeve 48 is merely pushed into an opening of the profile bar 2 and of the control sheet bar 45 and into a guide of the carrier 5. This sleeve 48 has a shoulder 47 which interacts with the opening in the sheet bar 45 so that, in the normal operating positions of the sheet bar 45, the sleeve 48 is prevented from falling out. The sleeve 48 can be removed without a tool by raising the sheet bar 45 until the margins of its opening for the passage of the sleeve 48 leave the region of the shoulder 47.

The thread-tensioning device described has, in addition to the advantages already mentioned, also that of a small space requirement. A large number of its individual parts, but especially those subject to wearing by the thread F, can be made of plastic and therefore at moderate cost, yet with high precision and without sharp edges.

The thread-tensioning device described is also easy to service. It can be dismantled using only a few movements and is assembled and fitted again just as quickly. By pulling the pressure element 33 to 38 laterally out of the clampling piece 40, the upper disc 4 becomes free and can be detached. By compressing the cams 15 of the rotary cage 10 the gearwheel 14 can be removed and the rotary cage 10 together with the lower disc 3 can thereafter be lifted out of the carrier 5. The thread-tensioning device is thus already stripped ready for general cleaning.

The foregoing preferred embodiment is considered as illustrative only. Numerous modifications and changes will readily occur to those skilled in the art.

I claim:

1. Thread-tensioning device on a warp creel, in which thread unwound from a bobbin is guided through in a straight line between discs of a disc brake, a lower disc of which is driven by a drive shaft running outside the disc periphery and an upper disc of which is pressable resiliently against the lower disc, and in which the thread is deflectable, as it leaves the warp creel, by a deflecting device towards a lapping machine, characterized in that:

said drive shaft for the drive of the lower disc at the same time forms the deflecting device for the thread; and said upper disc is centered peripherally and partly by a part which sits on the drive shaft in a turn-proof manner and causes, in a frictional manner, the upper disc to turn at least intermittently.

2. Thread-tensioning device, according to claim 1, characterized in that:

said drive shaft, serving as the deflecting device, is driven around in the direction of the run of the thread.

3. Thread-tensioning device, according to claim 1 or 2, characterized in that:

a carrier has positioning cams which are inserted into associated openings of a creel part; and said carrier is connected releasably to the creel part.

4. Thread-tensioning device, according to claim 1 or 2, characterized in that:

a deflecting sleeve, pushed onto the drive shaft, is situated in the region of the line of contact of the thread with the deflecting device.

5. Thread-tensioning device, according to claim 4, characterized in that:

said deflecting sleeve sits on the drive shaft in a turn-proof manner.

6. Thread-tensioning device, according to claim 4, characterized in that:

at one end of the deflecting sleeve, there adjoins a part of a carrier, by means of which the thread tensioning device is fastened to the warp creel and through which passes the drive shaft; and at the other end of the deflecting sleeve, there adjoins the part which causes the upper disc to turn at least intermittently.

7. Thread-tensioning device, according to claim 1 or 2, characterized in that:

said upper disc lies loosely on the lower disc and is held in an approximately central position, in relation to the lower disc, by a segment formed on a carrier of the thread-tensioning device, as well as by the part which causes said upper disc to turn at least intermittently.

8. Thread-tensioning device, according to claim 1 or 2, wherein:

said upper disc is pressed resiliently against the lower disc by a pressure element acting on the center of the upper disc via a spring;

said spring is supported at one end against a gripping sleeve;

said gripping sleeve is slidable on a pressure pin surrounded by said spring and is mounted releasably in a clamping piece;

said clamping piece is connected to a pedestal which is fastened to a displaceable sheet bar;

said sheet bar runs parallel to the pressure pin and, by means of which, the compressive load of several identical thread-tensioning devices is variable simultaneously.

9. Thread-tensioning device, according to claim 8, characterized in that:

said clamping piece is lockable in different positions with respect to the pedestal.

10. Thread-tensioning device, according to claim 8, characterized in that:

said thread is introduced through the warp creel by means of a sleeve which is pushed into the warp creel and through the sheet bar; and said sleeve has a shoulder which grips behind a margin of an opening in the sheet bar.

* * * * *